United States Patent [19]

Oswald

[11] Patent Number: 4,497,837

[45] Date of Patent: Feb. 5, 1985

[54] METHOD FOR ELECTROSTATIC, EPOXY COATING OF STEEL DRUM INTERIORS AND PRODUCT THEREOF

[75] Inventor: Donald E. Oswald, Arroyo Grande, Calif.

[73] Assignee: Kaiser Steel (Delaware), Inc., Fontana, Calif.

[21] Appl. No.: 368,033

[22] Filed: Apr. 13, 1982

Related U.S. Application Data

[63] Continuation of Ser. No. 917,807, Jun. 22, 1978, abandoned, which is a continuation-in-part of Ser. No. 759,342, Jan. 14, 1977, abandoned.

[51] Int. Cl.[3] ..... B65D 90/02; B65D 85/72; B05D 1/06

[52] U.S. Cl. ..... 426/398; 220/458; 427/28; 428/35; 426/131

[58] Field of Search ..... 426/131, 126, 398, 106; 220/458, 456, 454, 457; 428/35; 427/27–29, 33, 181, 183, 195, 231, 233, 234, 236, 239, 375, 379, 386, 410, 425

[56] References Cited

U.S. PATENT DOCUMENTS

| | | | |
|---|---|---|---|
| 2,285,370 | 6/1942 | Staelin . | |
| 2,737,461 | 3/1956 | Heisler et al. . | |
| 3,245,824 | 4/1966 | Treat et al. | 427/181 |
| 3,252,442 | 5/1966 | Hazlett . | |
| 3,260,611 | 7/1963 | Weidenhammer et al. . | |
| 3,268,344 | 8/1966 | Kamm | 426/131 |
| 3,414,425 | 12/1968 | Gerlovich . | |
| 3,450,303 | 6/1969 | Bosso et al. | 220/458 |
| 3,455,728 | 7/1969 | Kiwiet . | |
| 3,532,531 | 10/1970 | Stallard | 427/183 |
| 3,850,660 | 11/1974 | Inamura et al. | 427/28 |
| 3,904,930 | 9/1975 | Waldron et al. . | |
| 4,009,223 | 2/1977 | Noonan | 427/27 |
| 4,151,305 | 4/1979 | Davis | 426/131 |

FOREIGN PATENT DOCUMENTS

| | | | |
|---|---|---|---|
| 48-2782 | 1/1973 | Japan | 220/458 |
| 1075271 | 7/1967 | United Kingdom . | |

OTHER PUBLICATIONS

Metal Finishing, "Epoxy, Acrylic and Polyester Thermosetting Powders are Moving Toward Practical Application" by Kut, Jun. 1973, pp. 41–45.

Products Finishing, "Lining Steel Pipe with Epoxy Powder," Oct.1972, pp. 98 and 100.

*Primary Examiner*—Steven Weinstein

*Attorney, Agent, or Firm*—James E. Toomey; Dale Hoscheit; Robert G. Mukai

[57] ABSTRACT

A method of storing tomato paste and like corrosive materials, a method for lining drum shells, lids and filling hole covers, and a lining therefore, prior to the assembly of these parts to make steel drums. The above are carried out by pre-treating such parts by spraying with an alkaline solution, iron phosphate and also can be treated with a standard rust inhibitor. The interiors of the drum parts are coated by electrostatic spray application with a thermosetting epoxy-based powder to a specified thickness which eliminates subsequent cracking and subsequent vulnerability to destructive substances such as tomato paste and other more corrosive chemicals. The drum parts are preheated prior to the application of the powder to accelerate the fusion of the powder particle coating as well as reduce the associated material application problems. After application of the powder to the container interiors, the components are again subjected to oven temperatures to set and cure the coating.

10 Claims, No Drawings

METHOD FOR ELECTROSTATIC, EPOXY COATING OF STEEL DRUM INTERIORS AND PRODUCT THEREOF

RELATED APPLICATION

This application is a continuation of Ser. No. 917,807, filed June 22, 1978, now abandoned which is a continuation-in-part of Ser. No. 759,342, filed Jan. 14, 1977, now abandoned.

BACKGROUND OF THE INVENTION

This invention is directed to the preparation of a lining for metal containers such as standard steel drums as normally used for packing, transporting and storing materials over relatively long periods of time. Corrosive foodstuffs when packed in drums must be maintained in an aseptic condition so that contamination from defects in the protective lining of the drum occurring by reaction between the metal and the contents of the container is avoided. Typical contents are tomato paste, olives, cherries, wine concentrate and other acidic substances which form undesirable reactions when in direct contact with the metal containers. Of the above, tomato paste presents the most serious corrosion problem.

A typical metal container as employed with this invention is a so called "oil drum" type of container which is normally a 55-gallon cylindrical container used for industrial purposes such as transport of petroleum products, chemicals and many other products where the likelihood of corrosion is not as great as in the case of tomato paste and other corrosive materials, or where the consequences of such corrosion and resultant contamination are not as serious.

Apart from the present invention, there are only two commercial systems for packaging tomato paste corrosive foodstuffs in steel or other metal drums. One of them uses a product wherein at least all of the interior area of the drum, that is, the shell, top and bottom lids, are tin-coated and then coated with a phenolic resin. Tin-coating systems are very expensive and require high capital expense. Moreover, tinplate is a very expensive material to use for this purpose. The other commercial type of drum as used for tomato paste employs a polyvinyl chloride (PVC) lining for the metal container. However, in this day and age, when there is great concern about possible toxic effects of materials on human beings, there has been reluctance to manufacture a tomato paste drum having a PVC lining in the United States. Indeed, such product is not sold in the United States at this time.

In contrast to the foregoing, the present invention uses an epoxy resin lining material which is applied under special conditions with unexpected and surprising results, particlularly in the light of prior art teachings of using epoxy resins and other materials. The special lining of this invention and the method of applying it to steel drum shells and lids, include coating with a special primer after cleaning the metal surfaces in a conventional manner, electrostatically spray coating with the epoxy material under specific conditions to a specified and required thickness, and baking and curing the coating at times and temperatures which are compatible with a commercial process.

There are many teachings in the prior art. However, none of them disclose a coating material of epoxy powder that is applied by electrostatic spray to a controlled specific and narrow thickness range which has been found to be essential to attain the results of the present invention. For example, several references show the use of various powders, including epoxy resins for lining pipe, coating drums or wire coating or other products where the thickness of the coat does not appear to be a problem for the user. Such uses do not have the thickness requirements of this invention and in fact rely on thicker coatings. Ruptures, cracks, chipping and uneven thin linings do not present problems to the prior art, particularly of contaminations that result when there is exposure of metal to corrosive foodstuffs. Certain of these references are discussed below.

U.S. Pat. No. 3,414,425 relates to a method for coating black steel drums with a powdered resin or metallic powder, by discharging a curtain of particulate material from a slotted opening in an elongated trough onto the inner surface of the rotating drum. The only resin disclosed, however, is polyethylene. This does not suggest the use of an epoxy and the PE resin would actually be inoperative.

The article entitled "Epoxy, Acrylic and Polyester Thermosetting powders Are Moving Toward Practical Applications" in *Metal Finishing,* June, 1973 Pgs 41–45, discusses epoxy, acrylic and polyester thermosetting powders and primers. This is a general review article. The only epoxy process specifically described in detailis to provide *external* anticorrosive protection of the Alaskan pipeline. That process is quite different than the process of the present invention.

*Products Finishing,* October, 1972, Pgs 98 to 100, is entitled "Lining Steel Pipe With Epoxy Powder". This article, however, describes quite different coatings, such as an interior pipe lining of 24 mils thickness.

SUMMARY OF THE INVENTION

The present invention is directed to a specific coating and method which has met with remarkable commercial success. Essentially, it is to a particular coating and coating method for the interior of a steel drum and the lids for use with it, with an epoxy material after particular pretreatments and to a specific range of thicknesses, so as to provide a long-lasting anticorrosive internal layer which will provide a container suitable for the storage of tomato paste and like corrosive substances. In another of its aspects the invention is directed to a method of storing tomato paste in a container having the lining of this invention.

More particularly, the important and interrelated components of the invention comprise the following:

- Application of a primer coat of iron phosphate to the steel drum shell and lids and covers;
- Heating the steel surface to a temperature of 180°–220° F.;
- Electrostatically spray coating the metal surfaces with a thermosetting epoxy resin which melts and fuses at the surface temperatures;
- Coating the drum shell to a thickness between 1.5–3.0 mils; and
- Heating the surfaces to a temperature between 390°–420° F. for five to twelve minutes to set and cure the coating.

DETAILED DESCRIPTION OF THE INVENTION

The subject method of coating the drum shells, lids and covers includes the following steps:

1. Cleaning by abrasion
2. Washing
3. Rinsing
4. Iron phosphate application
5. Rinsing
6. Rust inhibitor application
7. Preheating
8. Powder coating application
9. Heating to set resin First, the drum components are cleaned and abraded by shot-blasting with small abrasive grit to provide anchor patterns in the metal for the anchoring of the subsequently applied powder.

The drum parts are then spray-washed with water of about 160° F. containing a small amount of alkali, 1.7% by weight of alkali.

Next, the drum parts are spray-rinsed in water at about room temperature.

The parts are then sprayed with an iron phosphate solution of, for example, 4.2% by weight of the phosphate in water, the solution being warm, e.g., 150° F. This is an important step in the process and it serves the purpose of providing a primer coating which serves to adhere the epoxy coating to the metal with optimum holding power.

The parts are then again spray-rinsed with water at about room temperature.

Next, the parts are sprayed with a rust inhibitor solution, for example, a 0.3% by weight solution of chromic acid in water, the solution being at about 140° F.

The drum parts are then heated until their surface temperature reaches about 200° F., the operative range being from about 180° to about 220° F.

Immediately after reaching the temperature of about 200° F. or 180°–220° F., the powder coating is spray applied through a conventional Ransburg-type of electrostatic spray applicator. At the temperature of the metal parts, the epoxy powder particles fuse directly to the metal and to each other to begin the cross-linking process necessary to form a pinhole-free coating of 1.5–3.0 mils in thickness. The preferred thickness is 2.0–2.5 mils. For example, under tomato paste handling conditions a coating thickness in excess of 3.0 mils leads to rupture or cracking of the coating, particularly on the surface of the filling hole cover, while a coating of less than 1.5 mils is vulnerable to penetration by the food acid of the tomato paste under the stress and strains of drum handling.

The preferred class of epoxy resin powders for use in the subject process is that of the diglycidal ethers of bisphenol-A resins (DGEBA). Of these, those compounded with aromatic amine, Lewis acid and acid anhydride curing agents are preferred. The selected powder should be free flowing, having a particle size range of 20–150 microns and preferably 30–70 microns, and have a melting point within the range of 180°–220° F. A fully satisfactory epoxy powder coating having such properties and characteristics is the 531–7076 grade of Du Pont Company's "Flintflex" powder coatings, or preferably Fuller-O'Brien No. E≠W-551-P-9.

Next, to set and cure the resin, the drum parts are heated to a metal surface temperature of about 400° F., i.e., from about 390° F. to about 420° F. for about six minutes, i.e., within a range of 5–12 minutes.

The subject method employs a Ransburg-type applicating system which operates according to the old and well-known electrostatic principle of applying an electrostatic charge to the powder particles and applying the charged particles to the grounded shell, lid and filling hole cover parts. Exemplary Ransburg-type application systems are shown and described in Ransburg, et al, U.S. Pat. No. 2,463,422; Ransburg, et al, U.S. Pat. No. 2,509,448; and Ransburg U.S. Pat. No. 2,567,781; and reference thereto may be had for a description of the principles involved and the operational detail that may be employed.

While a comprehensive process is described above, abrading and use of rust inhibitors, for example, may be omitted.

Assembled drums, the parts of which have been treated as described above, may safely be used without deterioration of the drums or contents in shipment, or in storage for extended periods. Such assembled drums are therefore particularly useful for the handling and storage of tomato paste, cherries, olives and other food products which have a great potential for corroding and destroying steel containers.

I claim:

1. A method of storing tomato paste which comprises storing tomato paste in an internally coated steel drum container having a coating which is a cured epoxy resin having a thickness ranging from 1.5 to 3.0 mils and is applied to the interior of the shell and lids of said container comprising the parts of said steel container exposed to said tomato paste, wherein said container parts are successively subjected to a primer coat of iron phosphate, heated to a surface temperature within the range of 180° to 220° F., electrostatically spray coated with an epoxy resin powder that melts and fuses to a thickness of 1.5 to 3.0 mils, and is subjected to a temperature within the range of 390° to 420° F. for a period of 5 to 12 minutes to enable the coat to set and cure and to form a non-corrosive adherent durable internal coating.

2. A steel drum container intended for use in packaging corrosive materials having an adherent, durable internal coating for which said coating is a cured epoxy resin having a thickness ranging from 1.5 to 3.0 mils and is applied to the shell and lids comprising the parts of said steel container exposed to said corrosive materials, wherein said container parts are successively subjected to a primer coat of iron phosphate, heated to a surface temperature within the range of 180° to 220° F., electrostatically spray coated with an epoxy resin powder that melts and fuses to a thickness of 1.5 to 3.0 mils, and is subjected to a temperature within the range of 390° to 420° F. for a period of 5 to 12 minutes to enable the coat to set and cure and to form a non-corrosive adherent durable internal coating, said coating being resistant to rupture or cracking and resistant to penetration by said corrosive materials.

3. The steel drum container of claim 2 wherein the container contains tomato paste as the corrosive material.

4. A method for protectively coating the inside surfaces of a steel drum shell and its related lid and filling hole cover to render the drum suitable for use as a container for tomato paste comprising applying a primer coating of iron phosphate thereto, heating said surfaces to a temperature of 180° to 220° F., electrostatically spray coating said heated surfaces with a thermosetting epoxy resin powder adapted to melt and fuse thereto at said temperature and building up said fused coating to a thickness of 1.5–3.0 mils, and heating said surfaces to a temperature of from about 390° F. to about 420° F. for a period of 5–12 minutes to set and cure said fused coating.

5. The method of claim 4, said epoxy resin being of the diglycidyl ether of bisphenol A type containing a curing agent selected from the group consisting of aromatic amines, Lewis acids and acid anhydrides.

6. The method of claim 4, wherein said resin powder is spray coated onto the inside surfaces of the drum shell in a radial spray pattern which is moved progressively along the length of the drum shell.

7. The method of claim 6, wherein said drum shell is rotated while being spray coated with said resin powder.

8. The method of claim 4, wherein said shell and its related lid and filling hole cover are subjected to an alkaline wash and water rinse prior to applying said primer coating of iron phosphate.

9. The method of claim 8, wherein said shell and its related lid and cover are spray rinsed with water after applying said primer coating of iron phosphate thereto.

10. The method of claim 4, wherein a rust inhibitor is applied to said shell, and its related lid and cover after said primer coating of iron phosphate has been applied.

* * * * *